US011137149B2

(12) United States Patent
Nilsson

(10) Patent No.: US 11,137,149 B2
(45) Date of Patent: Oct. 5, 2021

(54) DEVICE AND METHOD FOR CONTROLLING A SUPPLY AIR FLOW AT A COMFORT CASSETTE

(71) Applicant: FLÄKT WOODS AB, Jönköping (SE)

(72) Inventor: Per Nilsson, Tenhult (SE)

(73) Assignee: FLÄKTGROUP SWEDEN AB, Jönköping (SE)

( * ) Notice: Subject to any disclaimer, the term of this patent is extended or adjusted under 35 U.S.C. 154(b) by 296 days.

(21) Appl. No.: 15/756,609

(22) PCT Filed: Aug. 31, 2016

(86) PCT No.: PCT/SE2016/050816

§ 371 (c)(1),
(2) Date: Mar. 1, 2018

(87) PCT Pub. No.: WO2017/048173

PCT Pub. Date: Mar. 23, 2017

(65) Prior Publication Data

US 2018/0187904 A1 Jul. 5, 2018

(30) Foreign Application Priority Data

Sep. 17, 2015 (SE) ..... 1551192-6

(51) Int. Cl.
*F24F 1/01* (2011.01)
*F24F 13/12* (2006.01)
(Continued)

(52) U.S. Cl.
CPC ..... *F24F 1/01* (2013.01); *F24F 1/0011* (2013.01); *F24F 1/02* (2013.01); *F24F 13/06* (2013.01);
(Continued)

(58) Field of Classification Search
CPC ..... F24F 1/01; F24F 13/12; F24F 1/02; F24F 1/0059; F24F 1/0011; F24F 1/0007;
(Continued)

(56) References Cited

U.S. PATENT DOCUMENTS 4,535,685 A * 8/1985 Reuter ..... F24F 1/01 454/299
5,234,021 A * 8/1993 Kozlak ..... G01F 1/40 137/487
(Continued)

FOREIGN PATENT DOCUMENTS

DE 33 03 987 A1 8/1984
DE 101 17 045 A1 10/2001
(Continued)

OTHER PUBLICATIONS

"disc". Merriam-Webster, https://www.merriam-webster.com/dictionary/disc. 2019.*
(Continued)

*Primary Examiner* — Kenneth J Hansen
*Assistant Examiner* — Dana K Tighe
(74) *Attorney, Agent, or Firm* — Finch & Maloney, PLLC; Michael J. Bujold; Jay S. Franklin

(57) ABSTRACT

A comfort cassette (1) and a method which comprises a pressure box (2) with an inlet (3) and a plurality of outlets (4) for through flow of a supply air flow (L1). The outlets (4) are arranged at more than two of the pressure box edges (5*a*, 5*b*, . . . 5*n*) and form a group (6*a*, 6*b*, . . . 6*n*) of outlets per edge (5*a*, 5*b*, . . . 5*n*). The outlets are arranged in a configuration which is changeable by outlets (4) of a cover member (8) when the cover member (8) is displaced in relation to the outlets (4) of the pressure box (4). The cover member (8) is arranged to change simultaneously the configuration of all groups (6*a*, 6*b*, . . . 6*n*) of the outlets, by
(Continued)

movement of the cover member (8) in only one direction, while the supply air flow (L1) is changeable in more than two directions by movement of the cover member.

14 Claims, 3 Drawing Sheets

(51) Int. Cl.
*F24F 1/0011* (2019.01)
*F24F 1/02* (2019.01)
*F24F 13/06* (2006.01)
*F24F 1/0059* (2019.01)

(52) U.S. Cl.
CPC ..... *F24F 13/12* (2013.01); *F24F 1/0059* (2013.01); *F24F 2221/14* (2013.01)

(58) Field of Classification Search
CPC ..... F24F 1/0014; F24F 13/06; F24F 13/10; F24F 2221/14; F24F 2100/40; F24F 11/72; F24F 11/74
USPC ..... 454/237, 238
See application file for complete search history.

(56) References Cited

U.S. PATENT DOCUMENTS

| | | | | |
|---|---|---|---|---|
| 5,984,775 | A * | 11/1999 | Lee | F24F 13/12 454/187 |
| 2002/0056545 | A1 | 5/2002 | Horttanainen et al. | |
| 2002/0062948 | A1 | 5/2002 | Horttanainen et al. | |
| 2009/0264062 | A1 * | 10/2009 | Miller | F24F 1/0059 454/237 |
| 2012/0216986 | A1 * | 8/2012 | Kjellerstedt | F24F 1/0059 165/59 |
| 2012/0291994 | A1 * | 11/2012 | Ainley | F24F 1/0059 165/104.11 |
| 2017/0122611 | A1 | 5/2017 | Nilsson | |

FOREIGN PATENT DOCUMENTS

| | | | |
|---|---|---|---|
| EP | 1 188 992 | A2 | 3/2002 |
| EP | 1327833 | A1 | 7/2003 |
| FR | 2966562 | A1 | 4/2012 |
| GB | 2 364 117 | A1 | 1/2002 |
| GB | 2 415 248 | A | 12/2005 |
| JP | 2007303799 | A | 11/2007 |
| SE | 517998 | C2 * | 8/2002 |
| SE | 1450434 | A1 | 11/2015 |
| WO | 01/75374 | A1 | 10/2001 |
| WO | 03/027577 | A1 | 4/2003 |
| WO | 2011/040853 | A1 | 4/2011 |

OTHER PUBLICATIONS

"Machine Translation of SE517998". 2020.*
See International Search Corresponding to PCT/SE2016/050816 dated Dec. 6, 2016.
Written Opinion Corresponding to PCT/SE2016/050816 dated Dec. 6, 2016.
Supplementary European Search Report issued in corresponding European Patent Application No. 16846954.2 dated Apr. 8, 2019.
Singapore Search Report issued in corresponding Singaporean Patent Application No. 11201802131S dated Oct. 3, 2018.

* cited by examiner

DEVICE AND METHOD FOR CONTROLLING A SUPPLY AIR FLOW AT A COMFORT CASSETTE

TECHNICAL FIELD

The present invention relates to a device and a method for controlling a supply air flow at a type of chilled beam which may be termed cooling cassette, comfort module, comfort cassette or similar, which is used to provide supply air flow to a premises and control the room environment by cooling and/or heating. A chilled beam is often termed just as a chilled beam despite the fact that it nowadays also may comprise heating possibilities. The comfort cassette differs from the—since long known—chilled beam by the supply air flow distribution out from the comfort cassette occurs in more than two directions, which is the normal for a chilled beam. The comfort cassette has often a so called four-way air distribution.

BACKGROUND OF THE INVENTION

Within the field of air handling it is well known to use chilled beams to provide a premises with supply air and simultaneously control temperature and comfort in the premises by coordination of supply air and a circulation water flow through an Integrated cooling/heating coil. One problem with chilled beams delivering high cooling capacity is that they tend to be relatively elongated, thus occupying a large area/distance of the ceiling, where they normally are integrated to be able to deliver large cooling power and air flow within reasonable comfort demands. A more compact and space efficient variant has recently been developed and is basically a more compact chilled beam, but with four-way air distribution, which means that the air is distributed over a large ceiling area, yet the device is space efficient and space-saving. These units may be termed comfort module, climate cassette, cooling cassette or comfort cassette, and are manufactured in dimensions 600×600 mm and 600×1200 mm. Hereinafter in this application, the invention is termed comfort cassette and refers to a device which can be used for air supply and for cooling or for cooling and heating of the room air with one single device.

Developments in real estate operation constantly move towards improving energy efficiency and in recent years the development of so-called variable air volume (VAV) air treatment solutions has become increasingly important. More and more there are demands on that the ventilation of a premises is drawn down to a minimum during the time of non use of a premises, and is switched over to normal operation at registered presence, and also provides the possibility to further force the air flow to maintain a good indoor climate. The few manufacturers on the market which today deliver VAV solutions to comfort cassettes have a solution where the VAV-function comprises a damper placed in the supply air stream before the comfort cassette or integrated on the inlet to the comfort cassette. Within the field of chilled beams the applicant earlier has presented and filed a patent application of a solution of a pressure independent chilled beam with VAV-control directly on the outlets of the so-called pressure box, which is presented in SE1450434-4. Advantages with this technique compared to competing solutions are discussed in that application and thus not comprehensively discussed here. Because the comfort cassettes direct the air in more than two directions, normally four, it is a problem or at least it is more time consuming to set all the sides at set-up. Additionally, with today's solutions it is impossible to apply a VAV-solution that does not cause unwanted pressure drops, e.g., using an extra VAV-damper, in addition to the outlet pressure drop, and there are currently no solutions for adjusting the unit in all air distribution directions. There is thus a need of a comfort cassette with the ability to regulate the supply air in an energy-optimal way, and with the possibility of VAV control.

DISCLOSURE OF THE INVENTION

With the now present invention the object is achieved to solve the above problems in a first aspect of the invention, by a comfort cassette according to the preamble of claim 1, which is arranged to change the configuration at all groups of outlets, for supply air flow out from the comfort cassette pressure box, by only one movement of a cover member. In the preferred embodiment, the respective side/edge of the comfort cassette pressure box comprises one group of outlets, to let supply air flow stream in all directions where outlets are arranged, preferably perpendicular to the sides of the comfort cassette. Changing of the configuration of the groups means either that the number of outlets for outflow changes or that the outlet geometry as such changes regarding opening degree. The design of the cover member together with the outlet geometry, positioning and orientation enables that the movement of the cover member relative the outlets covers or opens the outlets, totally or partly, for through-flow of air, whereby the outflow of air from the comfort cassette is adjustable in all wanted directions where outlets are arranged. The outlets may for example be formed as elongated slots or alternatively round holes, which are grouped so that a different number of outlets are open depending on the placement of the cover member. There are no solutions today, where a comfort cassette with outflow in more than two directions, can be controlled by only one movement, which allows control of all sides simultaneously and enables the use of a cost-effective and energy-saving VAV-solution also at a comfort cassette.

According to a preferred embodiment of the invention the outlets are formed as elongated slots, which are orientated in a way that all slots have a longitudinal extent in the same direction as the direction of movement of the cover member. This means that a movement of the cover member for instance implies that all slots simultaneously begin to be covered, for example at a started closing movement, and all the slots thus are given the same opening degree around all edges/sides of the comfort cassette. Thus, for example the slots may be oriented along two edges of the pressure box and perpendicular to the other two edges of the pressure box, if it is preferred to have four-way air distribution. As previously mentioned, competitors' solutions do not at all offer solutions with control directly on the outlets, but have other forms of throttlings, which is not positive given the total pressure drop and thus the energy costs over the entire operating time for the comfort cassette.

According to another preferred embodiment the cover member is designed as a disc with portions close to the respective group of outlets, i.e. that parts of the disc will partly cover all outlets or completely cover some of the outlets in the respective group, while a linear movement of the disc is performed. Moving the cover member/disc to different positions will thus supply airflow change at all groups of outlets simultaneously. It is thus an advantage over the known solutions that only one integral part regulates all sides of the comfort cassette at once, wherein the air flow in all directions changes by a movement of a cover member.

Ina preferred embodiment of the comfort cassette the respective opening degree of the outlets is so designed that they are continuously adjustable between 0-100% in cooperation with the cover member displacement. This means that the flow can be fully adjusted to the needs of the premises that the comfort cassette serves, and moreover this fits well to a fully flexible VAV-solution, if there is a need for this. Known solutions have no ability to adjust the flow step-less in all directions, i.e. In addition to two directions, and do this through one single motion. With the present invention this is possible, which provides a quick adjustment of all sides and a possibility to have a completely VAV-controlled supply air flow.

Particularly preferred is that the outlets are arranged at four edges of the pressure box; that is, the comfort cassette is provided for four-way air distribution, which particularly for a need of high cooling capacity is advantageous to achieve good comfort in the premises served. One problem with today's comfort cassettes is that they cannot be regulated entirely according to VAV-principle while the pressure drop still is the lowest possible. At best, it is possible to regulate maximum two sides and keep a basic flow at the other two sides, but if this basic flow should be, for example, a "non-presence" flow, this flow should be low, not to cost unnecessary energy when the room is not in use. Also the possibility of a high air flow in all four directions gets limited, because the flow in two directions thus is low, because this flow can't be VAV-regulated. With the invention it is possible to have a fully adjustable comfort cassette with four-way air distribution with low flow at "non presence", but also with a high flow at high load in the premises, with high heating or cooling demand.

In a preferred embodiment of the invention an actuator is arranged at the comfort cassette, and the actuator is arranged to cooperate with the cover member to provide the change of air flow in all directions. The movement of the cover member takes place as previously described in one direction, and this together with that the cover member is a single integral part makes it possible to, with only one actuator, change the configuration at all groups of outlets and thereby regulate the air flow in all directions. In this way, a cost-effective VAV-control is achieved for said type of comfort cassette, which previously was not possible. A certain position of the actuator movement corresponds to a certain position of the cover member relative to the outlets of the pressure box, representing a particular configuration of the outlets, such as the number of open outlets, the size of the outlets, or to various large outlets opening for the flow of supply air. The actuator position is therefore equivalent to a so-called k-factor of the outlets; the k-factor is a familiar conception in air conditioning. The actuator is arranged to change the configuration of the groups of outlets, preferably by a linear movement of the cover member, whereby, in the preferred embodiment, the open area of the outlets for outflow of supply air out of the pressure box changes. Preferably, the outlets are designed as elongated slots which, for example, are punched out of the pressure box close to its edges. Outside, on the surface of the pressure box is the cover member arranged in connection with the groups of outlets, and in the form of a disc, also provided with punched elongated slots. By that the actuator is linear and connected to the cover member, the cover member is moved linearly in relation to the outlets and covers more or less of the outlets' open area to change the supply airflow. By that the performance and flow characteristics of the comfort cassette are determined by laboratory tests according to standard test methods, the so-called k-factor is known for various opening areas of the outlets. The k-factor in this case is dynamic; that is, it changes according to a curve, because that the slot area is changed step-less. The linear movement of the actuator is preferably performed by a shaft, which is moved by the actuator outwardly or inwardly relative to the actuator, resulting in the linear movement. The position of the actuator shaft corresponds to a certain opening degree of the gaps which then corresponds to a k-factor.

According to a preferred embodiment of the invention the new comfort cassette is linked to the applicant's patent SE1450434-4 by that the pressure box comprises a pressure measuring socket, which is useful for representative control of static pressure in the pressure box. This pressure together with that the actuator position is recordable gives that the actual supply air in the comfort cassette is known, according to the description above concerning the k-factor and the actuator. Thus it is possible to calculate the actual air flow based on the actuator position (from which the k-factor is known) and the static pressure in the comfort cassette pressure box. No previously known comfort cassettes offer this facility and known solutions cannot present a fully flexible comfort cassette with VAV-control directly at the outlets without unnecessary pressure loss.

From a second aspect of the invention the object is achieved to solve the above mentioned problems by a method for controlling the supply air flow at a comfort cassette according to the preamble of claim 8, and this method comprises that the supply air flow, and thus also the through induction generated circulation air flow, is changed in more than two directions, preferably four directions, by that a cover member is moved in only one direction. This is possible by that the outlets are arranged according to a configuration which is changeable by that the cover member is moved relative to the outlets and that all groups of outlets are changed simultaneously, by the movement of the cover member in the direction of movement. The outlets are arranged along more than two sides of the comfort cassette pressure box, which allows the supply airflow change at all sides where the outlets are provided, which has not previously been possible. In the preferred case the respective side/edge of the comfort cassette pressure box comprises a group of outlets, so that supply air can flow in all directions where outlets are arranged, preferably perpendicularly in relation to sides of the comfort cassette. Known solutions can only control the supply air by one cover member per group which changes the supply air to one side at a time, and they are only used when setting up the flow of the comfort cassette or if a need to change the air flow out of the comfort cassette occurs, due to change of use or for example draught problems in the premises. Alternatively, in some cases, the just mentioned manner for adjustment together with a volume control damper arranged before the comfort cassette or before the pressure box is used in the known solutions. With the now invented method all sides with outlets are regulated simultaneously, which provides a quick adjustment and the possibility of VAV-control in a cost effective and energy-wise good way.

In a preferred embodiment of the method of controlling the supply air flow at the comfort cassette, the cover member is moved by a linear movement, wherein the outlets entirely or partly are covered and thereby the supply air flow is changed. The linear motion is suitable both for outlets in the form of elongate slots, which then gradually get covered/opened by the linear movement of the cover member, and also for outlets in the form of holes, of which some get fully covered at different positions during movement of the cover member. The linear motion is well suited for precise control and for possible VAV-control, and a control of more than two sides by a linear movement of one cover member has not previously been possible in known solutions. Also preferred is that the movement of the cover member takes place step-less, and that the outlets are formed as elongated slots which are oriented in the same direction as the moving direction of the cover member, so that the respective outlet opening degree is gradually adjustable between 0-100%. The supply flow rate is thus regulated exactly as required and can thus very accurately be adjusted, for example, at increased or decreased supply air need, increased or reduced need for cooling or heating, etc.

According to another preferred embodiment of the method an actuator cooperates with the cover member to make the change of the configuration of the outlets. The actuator is provided at the comfort cassette so that the actuator is connected to the cover member, and by the actuator movement the cover member is displaced to the desired position to provide a configuration of the groups of outlets corresponding to a desired supply air flow. Through collaboration between the cover member and actuator the supply airflow through all sides of the comfort cassette that include outlets will be adjustable, which can be used both when setting up the air flow, and also at VAV-control. The setting of a comfort cassette with a factory-mounted actuator could for example be done in a simple and time-efficient manner by sending a control signal to the actuator, in order to move the cover member to the correct position and adjust the air flow to be—, for example, a basic flow through the comfort cassette. A very smooth method, useful to adjust and use the VAV-control at a comfort cassette with multi-way air distribution, is obtained, which gives full control of the supply air flow in all directions. This is not possible with known methods at a comfort cassette.

According to a preferred embodiment of the method the pressure box of the comfort cassette is provided with a pressure measuring socket, which is positioned so that a representative static pressure in the pressure box can be measured via the socket. This pressure is recorded either in a comprehensive control and monitoring system or directly into the actuator. The static pressure in the pressure box and the actuator position is recorded and on the basis of these the actual and correct supply air flow in the comfort cassette is calculated. Known methods at comfort cassettes do not offer this possibility and known solutions do not offer a way to record and calculate supply airflow at a fully flexible comfort cassette with VAV-control directly at the outlets, without excessive pressure drop through extra damper devices.

When the comfort cassette comprises an actuator and a pressure measuring socket it is, according to a preferred embodiment of the method, possible that the comfort criteria of the premises, like for example carbon dioxide level, temperature etc. is registered, and at an indicated need of a change of room climate, the supply air flow through the comfort cassette is changed. If the need indicates this the cover member moves by means of the actuator to in that way control the supply air flow through the comfort cassette, whereby the set-point for the premises eventually is achieved. By that all outlet directions at the comfort cassette are used, larger cooling loads may for instance be provided to the room in a better way compared to a traditional cooling beam with only two outlet directions.

By the invention a number of advantages over known solutions are obtained:

Control of air flow in more than two directions, but only through one single motion with one single cover member.

Full flexibility at VAV-control.

Full use of the advantageous four-way air distribution of the comfort cassette at VAV-control.

Possible to lower the air flow to zero.

Step-less control between 0-100% air flow in all directions.

No extra pressure drop from multiple throttling in series (VAV-damper and outlets).

The control is performed directly on the outlets of the pressure box.

The actual supply air flow in every operating point is known.

SHORT DESCRIPTION OF THE FIGURES

Below schematic figures show:

The structural design of the present invention is apparent in the following detailed description of an embodiment of the invention with reference to the accompanying drawings showing a preferred but not limiting embodiment of the invention.

DETAILED DESCRIPTION OF THE FIGURES

Figure 1:
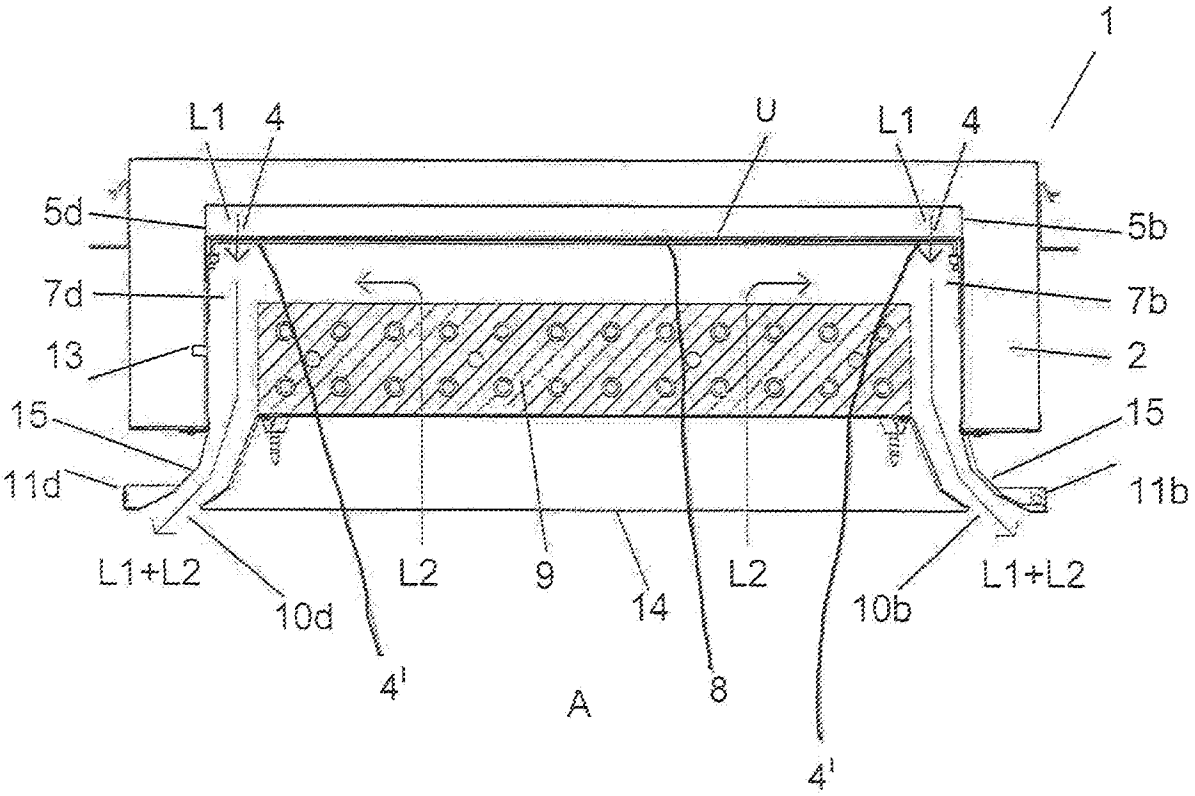
FIG. 1 shows a schematic sketch of a section through a comfort cassette according to the invention.

FIG. 1 shows a section through a comfort cassette 1 according to the invention. The comfort cassette 1 usually is adopted by dimensions with existing module dimensions for standard ceilings. According to the example the comfort cassette 1 is adopted to fit in module dimensions 600×600 mm or alternatively 600×1200 mm. Mainly the comfort cassette 1 comprises a pressure box 2, a heat exchanger 9, a lower part 14, preferably a perforated steel sheet, and side plates 15 plus a number of details for connecting and hinging of the unit in the ceiling. To the pressure box 2 is a supply air flow L1 supplied through an inlet 3 (see FIGS. 2 and 3) and the pressure box 2 comprises further a number of outlets 4, through which the supply air flow L1 flows. The outlets 4 are arranged along respective edge 5*a*,_5*b*, . . . 5*n* of the pressure box 2 and form by that a respective group 6*a*, 6*b*, . . . 6*n* per side (see FIG. 2). The supply air flow L1 that flows through the pressure box 2 builds up a certain pressure in the pressure box depending on the total area of open outlets 4 in relation to the supply air flow L1. When the supply air flow L1 flows further out through the outlets 4, a circulation flow L2 is generated through induction effect and the circulation airflow L2 is sucked, for example from a premises A, up through the heat exchanger 9 and is cooled or heated depending on the configuration of the comfort cassette 1. The supply airflow L1 and the circulation air flow L2 are mixed in a respective mixing chamber 7*b*, . . . 7*n* per side and flow out as a common air stream L1+L2 through a respective outlet opening 10*b*, . . . 10*n* per side 11*a*, 11*b*, . . . 11*n* of the comfort cassette 1. A cover member 8 is displaceable arranged on the underside U of the pressure box 2 and the cover member 8 of the preferred embodiment consists of an integral plate with portions in close connection to the outlets 4. When the outlets 4' of the cover member 8 are displaced, the outlets 4 in all groups 6*a*, 6*b*, . . . 6*n* will partially or completely be covered by the portions which are close to the outlets 4' of the cover member. The cover member 8 is according to FIG. 1 displaceable inwardly and outwardly relative to the viewer. In the figure is also shown a pressure measuring socket 13, which is useful for control of a representative static pressure in the pressure box 2.

Figure 2:
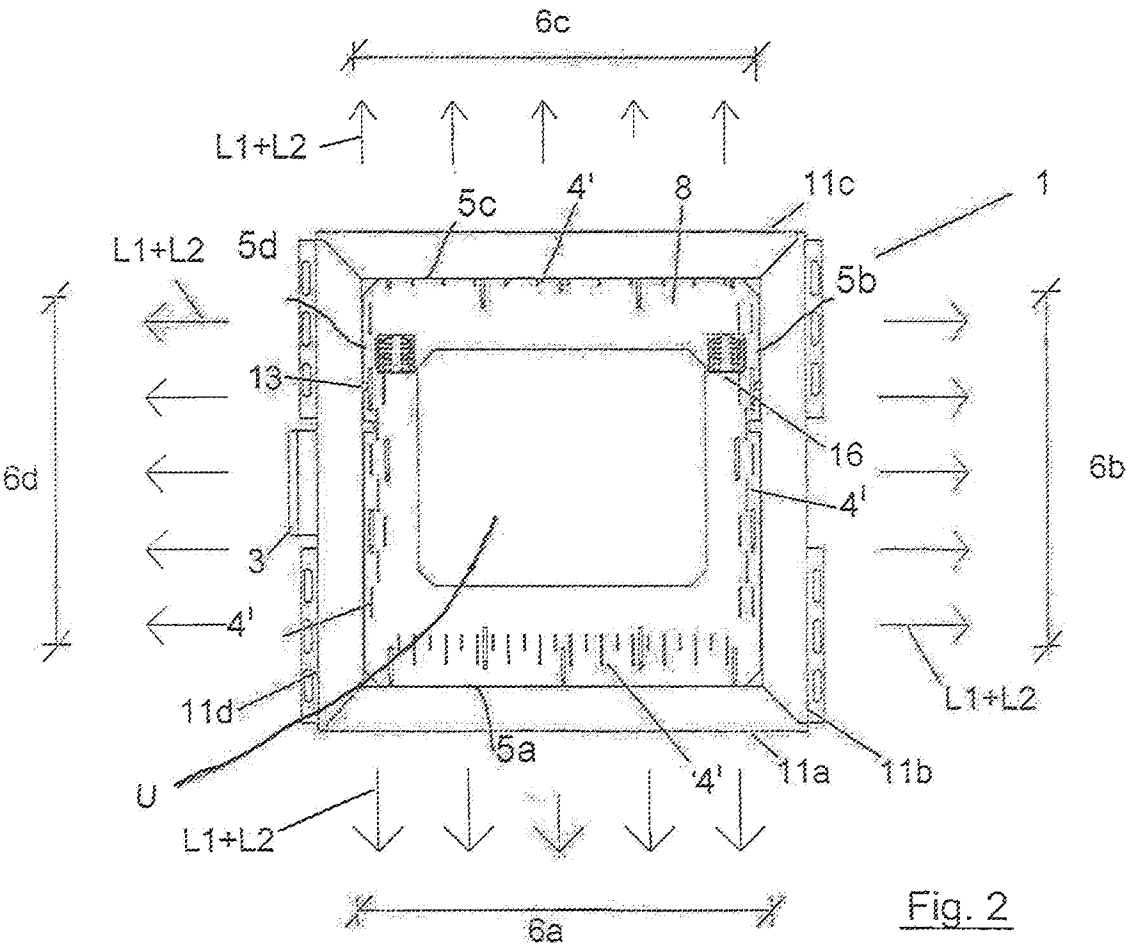
FIG. 2 shows a comfort cassette in a view straight from below, where the heat exchanger is removed.

FIG. 2 shows the comfort cassette 1 in a view straight from below and where the heat exchanger 9 is removed to better illustrate amongst other elements the cover member 8 and the outlets 4'. The outlets 4' are arranged in groups 6*a*, 6*b*, 6*c*, 6*d* with one group per side 11*a*, 11*b*, 11*c*, 11*d* of the comfort cassette 1. Symbolically the common air stream L1+L2 is drawn as arrows which illustrates the air leaving the comfort cassette 1 in four directions—so called four-way air distribution. The supply air flow L1 flows into the pressure box 2 via the inlet 3 and further out through the outlets 4, as described earlier. The outlets 4, 4' are according to the preferred embodiment arranged as elongated slots and orientated longitudinally and in the same direction as the moving direction of the cover member 8, at all groups 6*a*, 6*b*, 6*c*, 6*d* of outlets 4, 4'. In the figure, the cover member 8 can be moved back and forth in direction between the sides a-c. The cover member 8 is as earlier described arranged as a disc, preferably a disc with a hole in the middle to save material, but with portions of steel sheet or other suitable material in connection to the outlets 4. The cover member 8 is provided with corresponding slots as the outlets 4', and the slots will open the outlet 4 for through flow and respectively close the outlet 4 for throttling of supply air flow L1. In the figure can be seen at least one scale 16, which shows the number of millimeters of open outlet 4 area.

Figure 3:
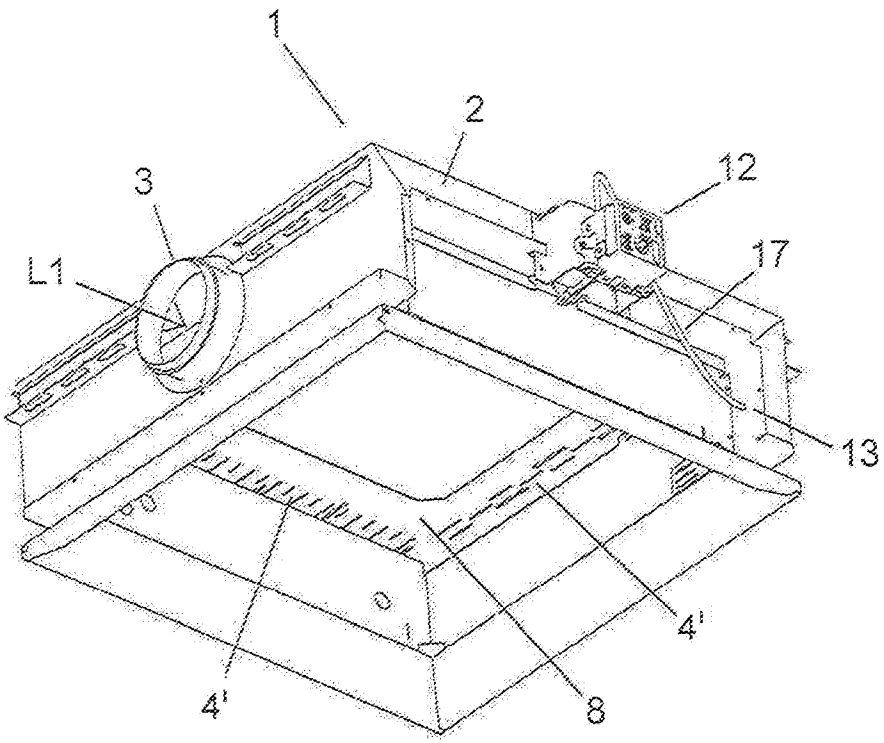
FIG. 3 shows a comfort cassette in a view obliquely from below, where the heat exchanger is removed and an actuator is provided on the comfort cassette.

FIG. 3 shows the comfort cassette 1 in a view obliquely from below, and where the heat exchanger 9 is removed to better illustrate amongst other elements the cover member 8 and the outlets 4'. Further, an actuator 12 is arranged at the comfort cassette 1, and the actuator 12 is arranged to move the cover member 8 by a linear movement. One end of a hose 17 connected to the actuator 12, and the other end of the hose 17 is connected to the pressure measuring socket 13. The actuator 12 registers the static pressure in the pressure box 2 via the pressure measuring socket 13 and the hose 17, and this pressure together with the information of the position of the actuator 12, gives through a calculation the knowledge of the actual and real supply air flow L1 through the comfort cassette 1. The inlet 3 connects to the comfort cassette 1 to a supply air duct (not shown), which is a part of an air handling system (not shown). Other details are apparent in the description in connection to FIGS. 1 and 2.

PARTS LIST

1=comfort cassette
2=pressure box
3=inlet
4=outlet
5=edge (pressure box)
6=group (outlet)
7=mixing chamber
8=cover member
9=heat exchanger
10=outlet opening
11=side (comfort cassette)
12=actuator
13=pressure measuring socket
14=lower part
15=side plate
16=scale
17=hose
A=premises
L1=supply air flow
L2=circulation air flow
L1+L2=common air stream

The invention claimed is:

1. A comfort cassette (1) comprising:

a pressure box (2) with at least one inlet (3) for inflow of supply air flow (L1) to the pressure box (2) and a plurality of outlets (4) for outflow of the supply air flow (L1) out of the pressure box (2), the outlets (4) of the pressure box (2) being arranged along more than two edges (5*a*, 5*b*, . . . 5*n*) of an underside of the pressure box (2), the outlets (4) of the pressure box (2) forming a group (6*a*, 6*b*, . . . 6*n*) of outlets per edge (5*a*, 5*b*, . . . 5*n*) of the pressure box (2), each respective group (6*a*, 6*b*, . . . 6*n*) of outlets (4) of the pressure box (2) being arranged to direct the supply air flow (L1) to a respective mixing chamber (7*b*, . . . 7*n*) per group (6*a*, 6*b*, . . . 6*n*), the comfort cassette (1) further comprising at least one coupled heat a exchanger (9) arranged to alternatively cool or heat a through-flowing air stream by heat exchange, and a circulation air flow (L2) being arranged to flow from a premises (A) through the heat exchanger (9) due to an induction effect driven by passage of supply air flow (L1) out of the outlets (4) to the respective mixing chamber (7*b*, . . . 7*n*), the respective mixing chamber (7*b*, . . . 7*n*) being arranged to unite the supply air flow (L1) from the pressure box (2) and the circulation air flow (L2), following conditioning of the circulation air flow (L2) by the heat exchanger (9), into a common air stream (L1+L2) and to guide the common air stream (L1+L2) to a respective outlet opening (10*b*, . . . 10*n*) for outflow to the premises (A), the outlets (4) of the pressure box (2) being arranged according to a configuration which is changeable by displacement of outlets (4') of a cover member (8) in relation to the outlets (4) of the pressure box (2), the cover member (8) being located between the heat exchanger (9) and the underside of the pressure box and the cover member (8) extending from adjacent a first edge (5*a*, 5*b*, . . . 5*n*) of the pressure box to adjacent a second opposed edge (5*a*, 5*b*, . . . 5*n*) of the pressure box for movement toward and away from the first and second edges of the pressure box (2) between the heat exchanger (9) and the underside of the pressure box, and the outlets (4, 4') of the pressure box and the cover member being arranged so that an outflow of the common air stream (L1+L2) flows out from the outlet openings in more than two directions, the outlets (4') of the cover member (8) being arranged to change a configuration of all groups (6*a*, 6*b*, . . . 6*n*) of outlets (4) simultaneously by movement of the cover member (8) in only a single direction of movement, and the supply air flow (L1) and thereby also the common air stream (L1+L2) out of the comfort cassette (1) being changeable in more than two directions by only a single movement of the cover member (8), whereby the outflow of the common air stream (L1+L2) out from the outlet openings is controlled in more than two directions by the single movement of the cover member.

2. The comfort cassette (1) according to claim 1, wherein the cover member (8) is designed as a pate with portions close to the groups (6*a*, 6*b*, . . . 6*n*) of outlets (4), and the pate being arranged to move linearly whereby the configuration of all groups (6*a*, 6*b*, . . . 6*n*) of the outlets (4) simultaneously change.

3. The comfort cassette (1) according to claim 1, wherein an opening degree of each respective outlet (4) of the pressure box (2) is step-less adjustable from 0-100%.

4. The comfort cassette (1) according to claim 1, wherein the outlets (4) are arranged along four edges (5*a*, 5*b*, 5*c*, 5*d*) of the pressure box (2) and the outflow of the common air stream (L1+L2) flows out from the respective outlet opening (10*b*, 10*d*) simultaneously in four different directions, so-called four-way air distribution, whereby an air flow is controlled in all four directions by a change of a configuration of the outlets (4).

5. The comfort cassette (1) according to claim 1, wherein at least one actuator (12) is arranged at the comfort cassette (1), the at least one actuator (12) is further arranged to cooperate with the cover member (8) to provide the change of configuration of the groups (6*a*, 6*b*, . . . 6*n*) of the outlets (4).

6. The comfort cassette (1) according to claim 5, wherein the pressure box (2) comprises at least one pressure measuring socket (13), useful for representative control of a static pressure (ps) in the pressure box (2), and the static pressure (ps) in the pressure box (2) and a position of the at least one actuator (12) is recordable, and the supply airflow (L1) in the comfort cassette (1) is calculable based on the static pressure (ps) and the position of the at least one actuator (12).

7. A method for controlling supply air flow (L1) at a comfort cassette (1), comprising a pressure box (2) with at least one inlet (3) for inflow of supply air flow (L1) to the pressure box (2) and a plurality of outlets (4) for outflow of the supply air flow (L1) out of the pressure box (2), the outlets (4) of the pressure box (2) are arranged along more than two edges (5*a*, 5*b*, . . . 5*n*) of an underside of the pressure box (2), wherein the outlets (4) of the pressure box (2) form a group (6*a*, 6*b*, . . . 6*n*) of outlets per edge (5*a*, 5*b*, . . . 5*n*) of the pressure box (2), and each respective group (6*a*, 6*b*, . . . 6*n*) streams the supply air flow (L1) to a respective mixing chamber (7*b*, . . . 7*n*) per group (6*a*, 6*b*, . . . 6*n*), the comfort cassette (1) further comprising at least one coupled heat exchanger (9) arranged alternatively to cool or heat a through-flowing air stream by a heat exchange, and a circulation air flow (L2) flows through the heat exchanger (9) from a premises (A) due to induction effect driven by a passage of supply air flow (L1) out of the outlets (4) of the pressure box (2) to the respective mixing chamber (7*b*, . . . 7*n*), and the respective mixing chamber (7*b*, . . . 7*n*) unites the supply air flow (L1) and the circulation air flow (L2), conditioned by the heat exchanger (9), to a common air stream (L1+L2) and guides the common air stream (L1+L2) to a respective outlet opening (10*b*, . . . 10*n*) for outflow to the premises (A) simultaneously in different directions, the outlets being arranged so that an outflow of the common air stream (L1+L2) flows out from the outlet openings in more than two directions, the method comprising:

arranging the outlets (4) of the pressure box (2) according to a configuration which is changeable by outlets (4) of a cover member (8) which is displaced in relation to the outlets (4), locating the cover member (8) between the heat exchanger (9) and the underside of the pressure box and extending the cover member (8) from adjacent a first edge (5*a*, 5*b*, . . . 5*n*) of the pressure box to adjacent a second opposed edge (5*a*, 5*b*, . . . 5*n*) of the pressure box for movement toward and away from the first and second edges of the pressure box (2) between the heat exchanger (9) and the underside of the pressure box, performing step-less movement of the cover member (8), and forming the outlets (4) of the pressure box and the outlets (4) of the cover member (8) as elongated slots which are orientated longitudinally in a direction of movement of the cover member (8), whereby an opening degree of the respective outlet (4) of the pressure box (2) is step-less adjustable from 0-100%, simultaneously changing the configuration at all groups (6*a*, 6*b*, . . . 6*n*) of the outlets (4) by a movement of the cover member (8) in only one direction, and changing the supply air flow (L1), and thereby also the common air stream (L1+L2) out of the comfort cassette (1), in more than two directions by only movement of the cover member (8) in a single direction, whereby the outflow of the common air stream (L1+L2) out from the outlet openings is controlled in more than two directions by the single movement of the cover member.

8. The method according to claim 7, further comprising linearly changing movement of the cover member (8).

9. The comfort cassette (1) according to claim 5, wherein the outlets (4) of the pressure box (2) and the outlets of the cover member (8) are all formed as elongated slots which are orientated longitudinally in a direction which extends parallel to the direction of movement of the cover member (8).

10. The method according to claim 7, further comprising at least one actuator (12) cooperating with the cover member (8) to provide the change of configuration of the groups (6*a*, 6*b*, . . . 6*n*).

11. The method according to claim 10, further comprising the pressure box (2) comprises at least one pressure measuring socket (13), useful for representative control of static pressure (ps) in the pressure box (2), registering the static pressure (ps) in the pressure box (2) and a position of the at least one actuator (12), and calculating a real supply airflow (L1) in the comfort cassette (1) based on the static pressure (ps) and the position of the at least one actuator (12).

12. The method according to claim 11, further comprising moving, at a detected need of change of air flow and/or comfort in the premises, the cover member (8), via the at least one actuator (12), to regulate a desired set point based on the supply air flow (L1).

13. A comfort cassette (1) comprising:

a pressure box (2) having at least one inlet (3) for inflow of supply air flow (L1) into the pressure box (2) and a plurality of outlets (4) for outflow of the supply air flow (L1) out of the pressure box (2), the outlets (4) of the pressure box (2) being arranged on an underside (U) of the pressure box (2) along at least four edges (5*a*, 5*b*, . . . 5*n*) thereof, the outlets (4) being combined so as to form groups (6*a*, 6*b*, . . . 6*n*) of outlets located along each edge (5*a*, 5*b*, . . . 5*n*) of the pressure box (2), each respective group (6*a*, 6*b*, . . . 6*n*) of outlets (4) being arranged to direct the supply air flow (L1) toward a respective mixing chamber (7*b*, . . . 7*n*) associated with each group (6*a*, 6*b*, . . . 6*n*), the comfort cassette (1) further comprising at least one coupled heat exchanger (9) arranged to alternatively cool or heat a through-flowing air stream flowing from a premises (A) through the heat exchanger (9) due to an induction effect caused by passage of supply air flow (L1) out of the outlets (4) to the respective mixing chamber (7*b*, . . . 7*n*), the respective mixing chamber (7*b*, . . . 7*n*) being arranged to unite the supply air flow (L1) from the outlets (4) with the circulation air flow (L2), following conditioning of the circulation air flow (L2) flowing through by the heat exchanger (9), into a common air stream (L1+L2) and to guide the common air stream (L1+L2) to a respective outlet opening (10*b*, . . . 10*n*) for outflow to the premises (A), a single cover member (8), having a plurality of openings (4') being located between the heat exchanger (9) and the undersurface of the pressure box, which extends parallel to a surface of the heat exchanger (9) which faces toward the underside (U) of the pressure box (2), and the single cover member (8) extending from adjacent a first edge (5*a*, 5*b*, . . . 5*n*) of the pressure box to adjacent a second opposed edge (5*a*, 5*b*, . . . 5*n*) of the pressure box between the heat exchanger (9) and the underside (U) of the pressure box, the outlets (4) of the cover member (8) being arranged according to a configuration which is changeable by displacement of the single cover member (8) relative to the outlets (4) of the pressure box (2), and the outlets being arranged so that an outflow of the common air stream (L1+L2) flows out from the outlet openings in more than two directions, the outlets (4, 4') of the pressure box and the cover member each being formed as elongated slots which are orientated along the direction of displacement of the single cover member (8), the single cover member (8) being arranged to change a configuration of all groups (6*a*, 6*b*, . . . 6*n*) of the outlets (4) simultaneously by movement of the single cover member (8) in only a single direction of movement away from the first edge of the pressure box (2) toward the opposite second edge of the pressure box (2) or vice versa, and the supply air flow (L1), and thereby also the common air stream (L1+L2) out of the comfort cassette (1), being changeable in more than two directions by movement of the single cover member (8) either toward or away from the first edge of the pressure box (2), whereby the outflow of the common air stream (L1+L2) out from the outlet openings is controlled in more than two directions solely by the movement of the single cover member.

14. The comfort cassette according to claim 13, further comprising an actuator (12) which cooperates with the cover member (8) to move the cover member (8) either toward or away from the first edge of the pressure box (2).

* * * * *